US009580283B2

(12) United States Patent
Copeland

(10) Patent No.: US 9,580,283 B2
(45) Date of Patent: Feb. 28, 2017

(54) METHOD AND SYSTEM FOR INSTALLATION AND REMOVAL OF BALLAST

(71) Applicant: Tadano Mantis Corporation, Franklin, TN (US)

(72) Inventor: Daniel Copeland, Franklin, TN (US)

(73) Assignee: TADANO MANTIS CORPORATION, Franklin, TN (US)

( * ) Notice: Subject to any disclaimer, the term of this patent is extended or adjusted under 35 U.S.C. 154(b) by 86 days.

(21) Appl. No.: 14/193,607

(22) Filed: Feb. 28, 2014

(65) Prior Publication Data

US 2015/0246795 A1 Sep. 3, 2015

(51) Int. Cl.

| | |
|---|---|
| ***B66C 23/74*** | (2006.01) |
| ***B66C 23/76*** | (2006.01) |
| ***E02F 9/18*** | (2006.01) |

(52) U.S. Cl.

CPC ..... *B66C 23/76* (2013.01); *B66C 23/74* (2013.01); *E02F 9/18* (2013.01); *Y10T 29/49819* (2015.01); *Y10T 29/49826* (2015.01); *Y10T 29/49838* (2015.01)

(58) Field of Classification Search

CPC ..... B66C 23/72–23/76

See application file for complete search history.

(56) References Cited

U.S. PATENT DOCUMENTS

| | | | | |
|---|---|---|---|---|
| 3,726,416 A | | 4/1973 | Pottorff et al. | |
| 4,081,081 A | * | 3/1978 | Morrow, Sr. | B66C 23/74 212/178 |
| 7,389,888 B2 | * | 6/2008 | Willim | B66C 23/74 212/178 |
| 2007/0090074 A1 | | 4/2007 | Willim | |
| 2012/0160795 A1 | * | 6/2012 | Liu | B66C 23/74 212/178 |

FOREIGN PATENT DOCUMENTS

| | | |
|---|---|---|
| DE | 3708458 | 9/1988 |

OTHER PUBLICATIONS

Extended European Search Report for EP App No. 15157058.7 dated Jul. 17, 2015, 8 pgs.

Communication Pursuant to Article 94(3) EPC for EP App No. 15157058.7 dated Aug. 3, 2016, 4 pgs.

* cited by examiner

*Primary Examiner* — Sang Kim
*Assistant Examiner* — Juan Campos, Jr.
(74) *Attorney, Agent, or Firm* — Procopio, Cory, Hargreaves & Savitch LLP

(57) ABSTRACT

A ballast system for heavy equipment including a ballast weight configured to be removably mounted, proximate to an end of a portion of the horizontal structure of the heavy equipment, at least one actuator mounted on the horizontal structure of the heavy equipment, operable between a first position and a second position, and oriented to actuate horizontally along at least a portion of the horizontal structure, at least one tension member that connects the ballast weight to the actuator and is configured to move the ballast weight vertically in response to the at least one actuator actuating along at least a portion of the horizontal structure; and a locking mechanism configured to removably attach the ballast weight to the end portion of the horizontal structure.

17 Claims, 8 Drawing Sheets

METHOD AND SYSTEM FOR INSTALLATION AND REMOVAL OF BALLAST

FIELD

The present disclosure relates generally to construction equipment and other heavy machinery which requires on-board ballast, and more specifically, heavy machinery that may self-install and remove the on-board ballast for specific machine operations, or for equipment transport.

RELATED ART

Related art construction equipment, or other heavy equipment sometimes requires on-board ballast for proper functionality. However, such equipment often needs to have the ballast removed periodically. For example, the related art ballast may need to be transported separately from the rest of the equipment due to weight or size restrictions.

Some related art methods or systems for installing and removing ballast from construction equipment, or other heavy equipment may involve installation and removal of the ballast by a separate crane or other lifting equipment. Other related art methods or systems may involve attaching the ballast to the equipment with an auxiliary or temporary rope and raising or lowering the ballast via movement of the boom of the equipment. Other related art methods or systems may involve lifting the ballast using vertically oriented hydraulic cylinders.

These related art methods or systems may require additional equipment, which may increase the cost of equipment operation. Further, the related art methods or systems may require the use of auxiliary or temporary ropes, which can be unsafe to use or/and inconvenient to install. Further, related art methods and systems using vertically mounted hydraulics can be sensitive to damage during transport and can be bulky, increasing overall machine transport dimensions. If transport of the equipment via the foregoing related art methods or systems is sensitive to damage, or the transport dimensions are too large, the cost associated with equipment operation may increase, and operational safety may be reduced.

SUMMARY

A first example implementation may include a ballast system for heavy equipment including a horizontal structure, the ballast system including a ballast weight configured to be removably mounted, proximate to an end of a portion of the horizontal structure of the heavy equipment, at least one actuator mounted on the horizontal structure of the heavy equipment, the at least one actuator operable between a first position and a second position, and oriented to actuate horizontally along at least a portion of the horizontal structure, at least one tension member that connects the ballast weight to the actuator and is configured to move the ballast weight vertically in response to the at least one actuator actuating along at least a portion of the horizontal structure, and a locking mechanism configured to removably attach the ballast weight to the end portion of the horizontal structure.

Another example implementation may include a piece of heavy equipment including a horizontal structure, a base structure vertically separated from the horizontal structure, and a ballast system including a ballast weight configured to be removably mounted, proximate to an end of a portion of the horizontal structure of the heavy equipment, at least one actuator mounted on the horizontal structure of the heavy equipment, the at least one actuator operable between a first position and a second position, and oriented to actuate horizontally along at least a portion of the horizontal structure, at least one tension member that connects the ballast weight to the actuator and is configured to move the ballast weight vertically in response to the at least one actuator actuating along at least a portion of the horizontal structure, and a locking mechanism configured to removably attach the ballast weight to the end portion of the horizontal structure.

Yet another example implementation may include A method of removably installing ballast on heavy equipment comprising a horizontal structure, the method including providing a ballast weight configured to be removably attached to an end of a portion of the horizontal structure, providing an actuator on the horizontal structure, attaching a tension member between the actuator and the ballast weight, actuating the actuator to move horizontally along a portion of the horizontal structure so as to vertically lift the ballast weight vertically toward the end of the portion of the horizontal structure, and engaging a locking mechanism to attach the ballast weight to the end portion of the horizontal structure.

BRIEF DESCRIPTION OF THE DRAWINGS

One or more example implementations will now be described with reference to the drawings. The drawings and the associated descriptions are provided to illustrate example implementations of the disclosure and not to limit the scope of the disclosure. Throughout the drawings, reference numbers are maintained to indicate correspondence between referenced elements.

DETAILED DESCRIPTION

The subject matter described herein is taught by way of example implementations. Various details have been omitted for the sake of clarity and to avoid obscuring the subject matter. The examples shown below are directed to structures and methods for implementing installation and removal of ballast.

Figure 1:
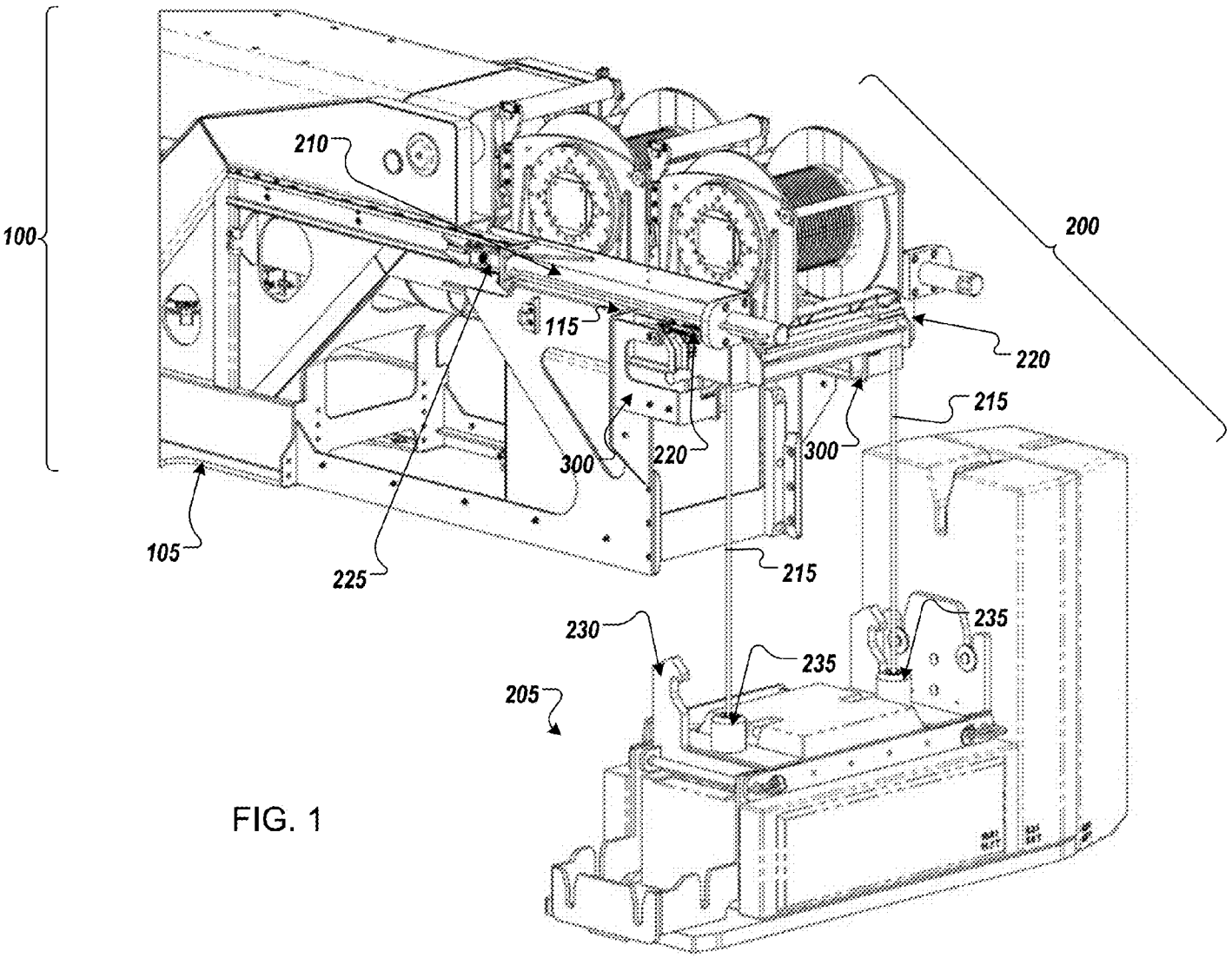
FIG. 1 is a perspective view of a piece of heavy equipment with an on-board ballast system according to a first example implementation in a first position.
Figure 2:
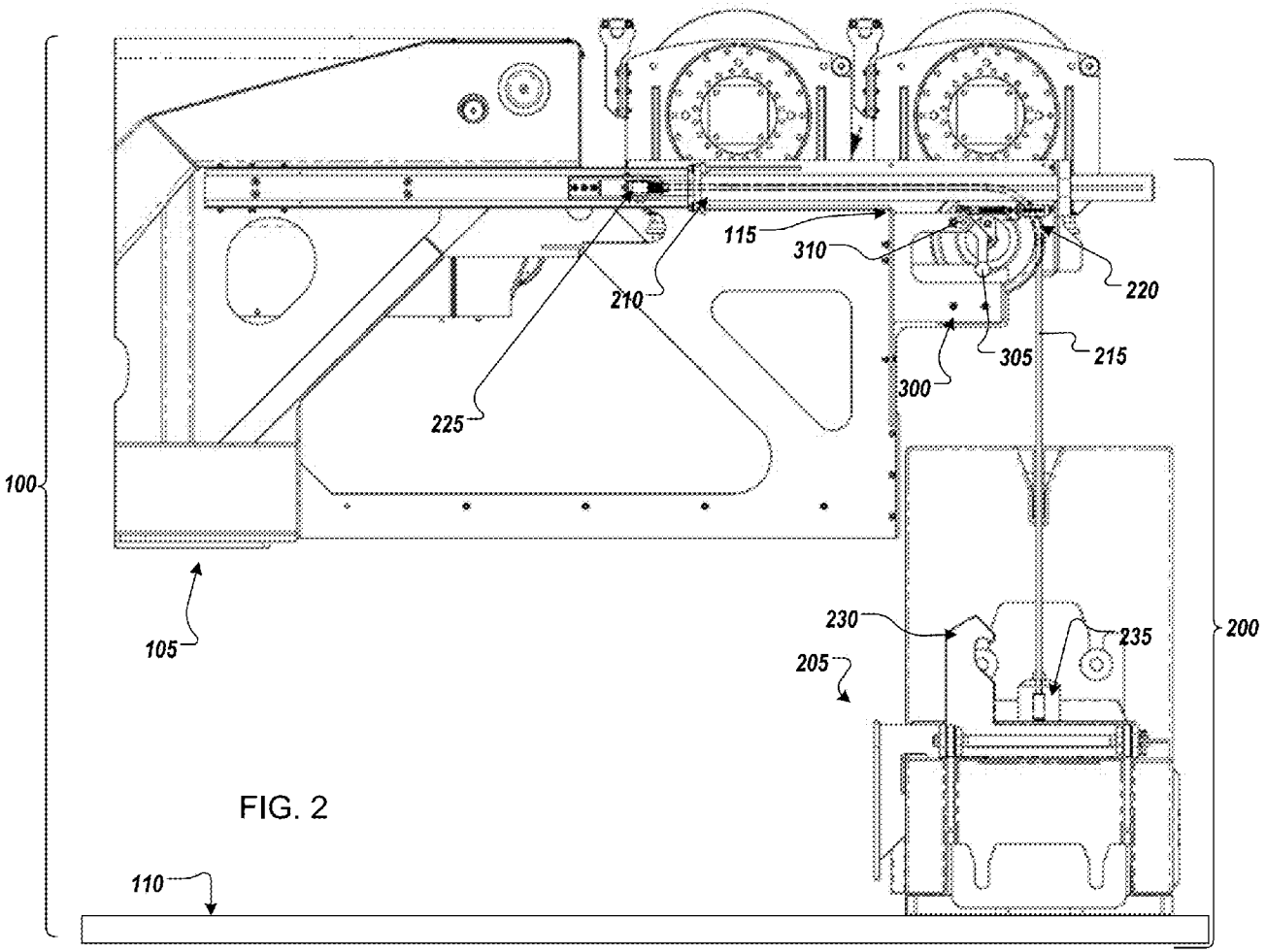
FIG. 2 is a side view of a piece of heavy equipment with an on-board ballast system according to a first example implementation in a first position.
Figure 3:
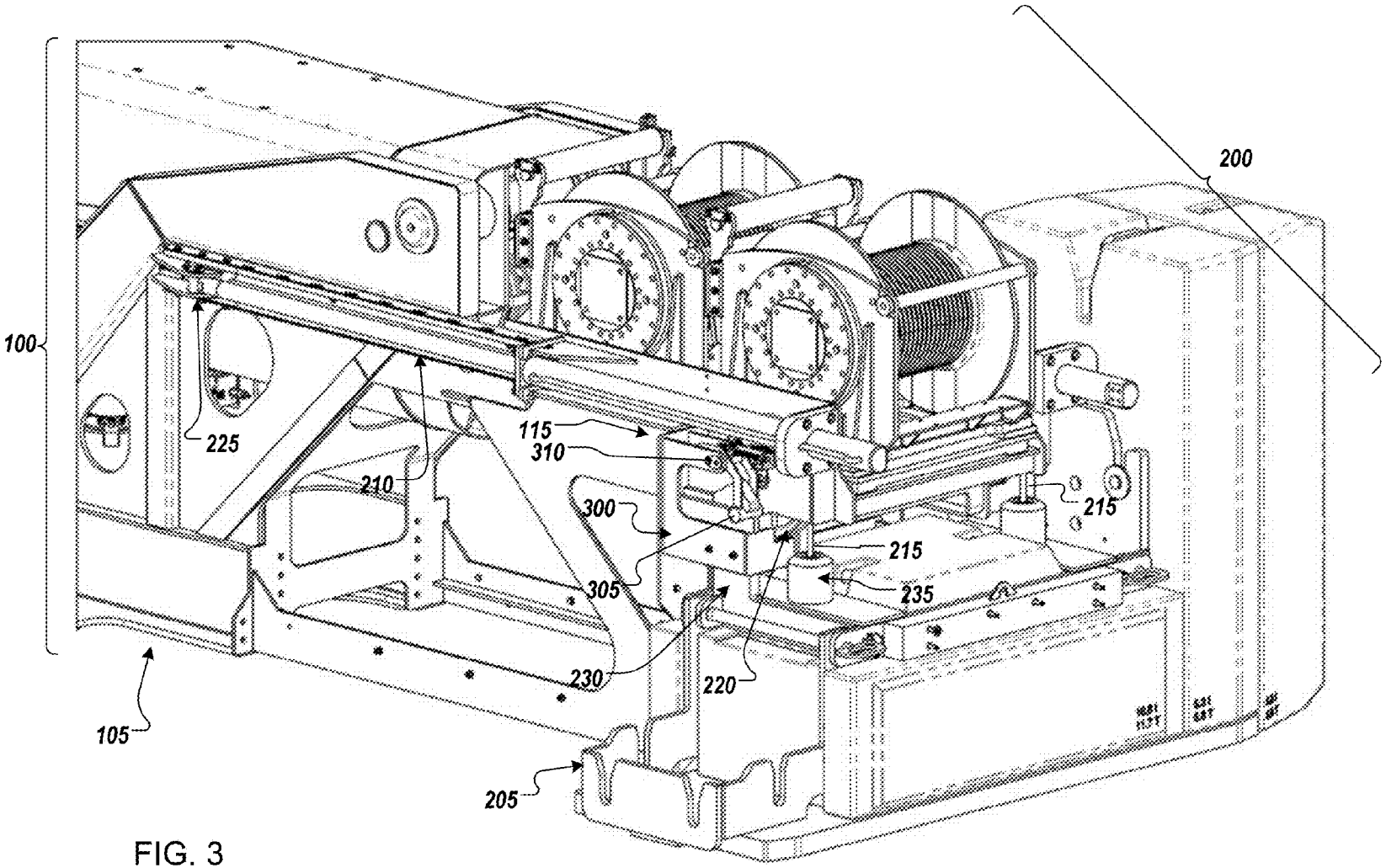
FIG. 3 is a perspective view of a piece of heavy equipment with an on-board ballast system according to a first example implementation in a second position.
Figure 4:
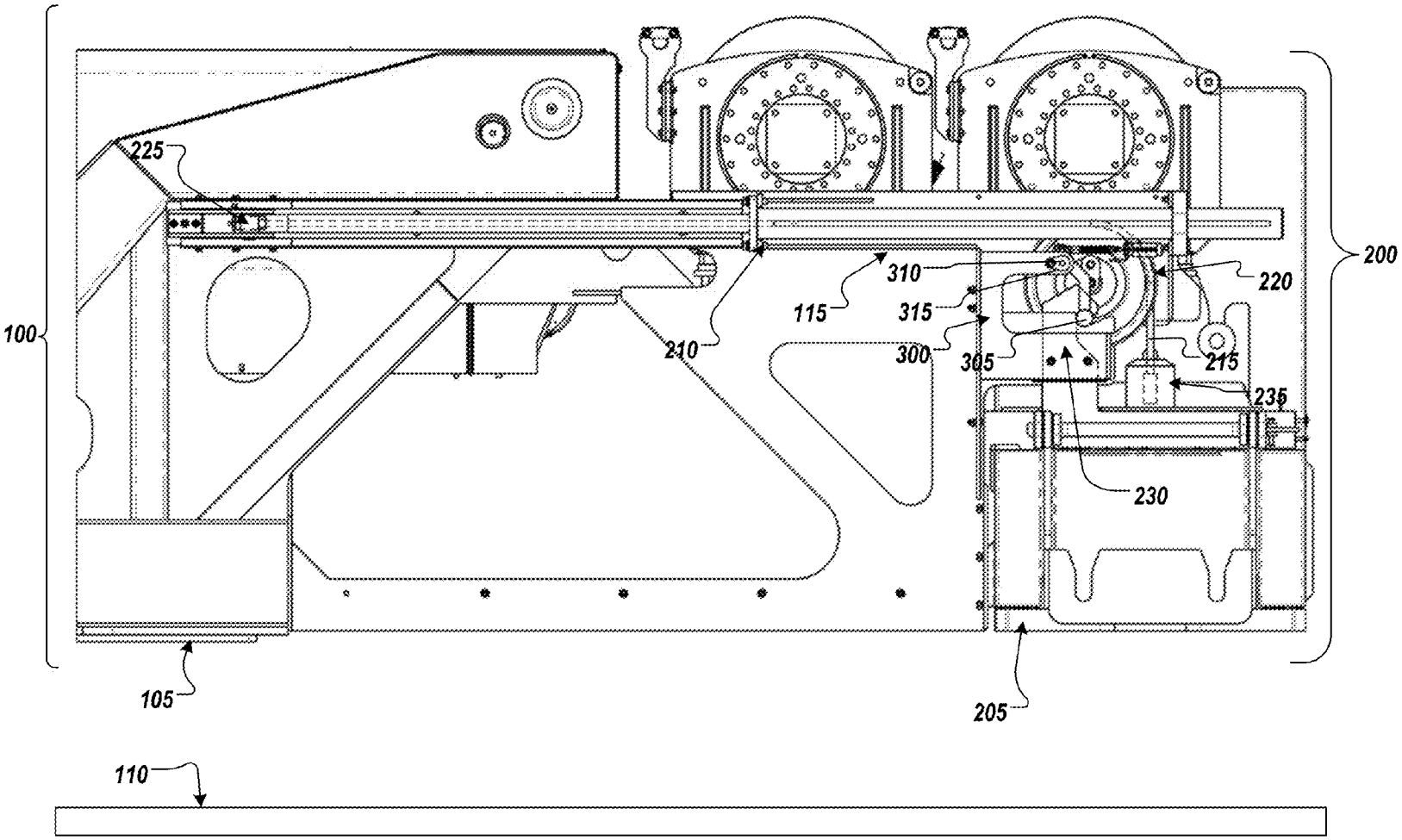
FIG. 4 is a side view of a piece of heavy equipment with an on-board ballast system according to a first example implementation in a second position.
Figure 7:
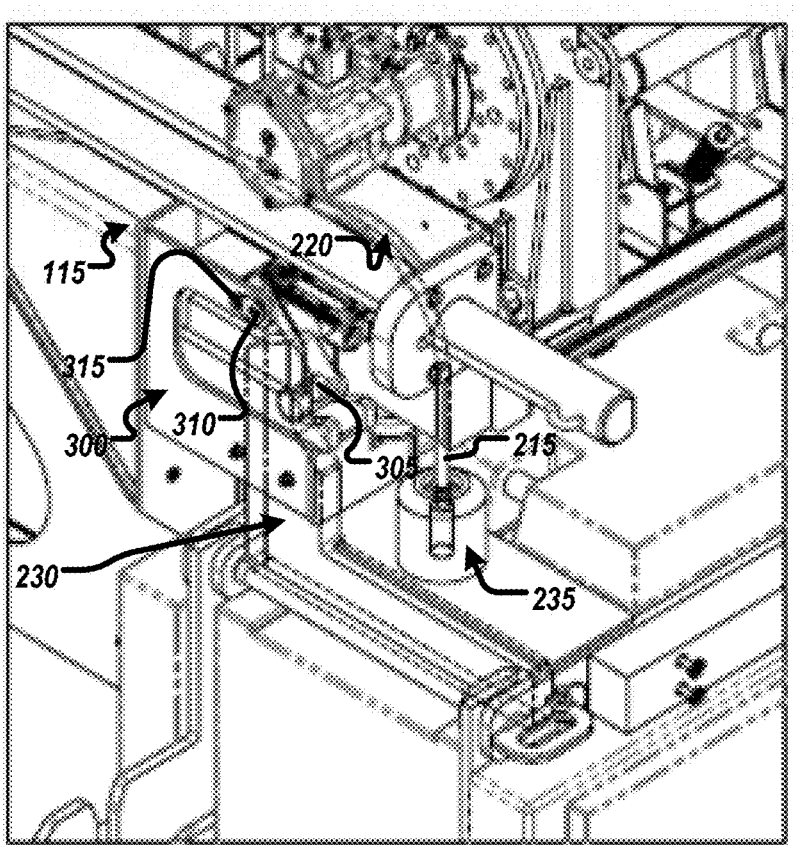
FIG. 7 is an enlarged perspective view of a locking mechanism of an on-board ballast system according to a first example implementation.
Figure 8:
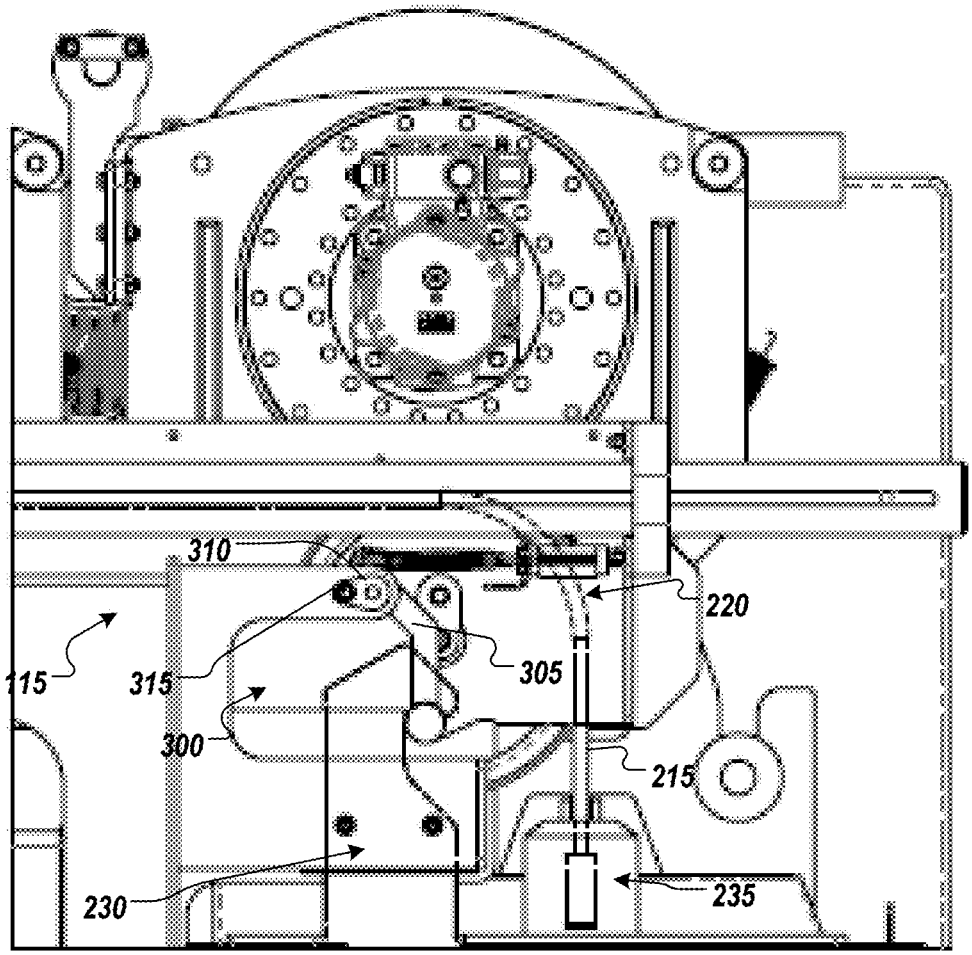
FIG. 8 is an enlarged side view of a locking mechanism of an on-board ballast system according to a first example implementation.

FIG. 1 is a perspective view of a piece of heavy equipment 100 with an on-board ballast system 200 according to a first example implementation in a first (e.g., un-installed) position. FIG. 2 is a side view of a piece of heavy equipment 100 with an on-board ballast system 200 according to a first example implementation in first (e.g., un-installed) position. FIG. 3 is a perspective view of a piece of heavy equipment 100 with an on-board ballast system 200 according to a first example implementation in a second (e.g., installed) position. FIG. 4 is a perspective view of a piece of heavy equipment 100 with an on-board ballast system 200 according to a first example implementation in a second (e.g., installed) position. FIG. 7 is an enlarged perspective view of a locking 300 mechanism of an on-board ballast system 200 according to a first example implementation. FIG. 8 is an enlarged side view of a locking mechanism 300 of an on-board ballast system 200 according to a first example implementation.

Referring to the FIGS. 1-4, the heavy equipment 100 includes a horizontal section 105 extending substantially horizontally on which a ballast weight 205 needs to be mounted. For example, and not by way of limitation, the horizontal section 105 may be the upper works or upper boom of a construction crane. However, example implementations of the present application, the heavy equipment 100 is not limited to a crane structure and the horizontal section 105 is not limited to the upper works or upper boom of a construction crane.

Further, example implementations of the heavy equipment 100 may also include a base 110 (illustrated in FIGS. 2 and 4) to which the ballast weight 205 may lowered to as illustrated in FIG. 2. However, example implementations of need not require the ballast weight 205 to be lowered to a base 110 of the heavy equipment. In such example implementations, the ballast weight 205 may rest on a surface below the horizontal section when in a lowered (e.g., un-installed) position.

The on-board ballast system 200 illustrated in FIGS. 1 and 2 includes ballast weight 205, actuator mechanism 210, tension member 215 and locking mechanism 300. In this example implementation, the actuator mechanism 210 is mounted to the horizontal section 105 of the heavy equipment 100 at or near an end 115 of the horizontal section 105. Further, the actuator mechanism 210 is oriented to actuate horizontally between a first position (e.g. collapsed or retracted position) and a second position (e.g. extended position) along a portion of the length of the horizontal section 105. In this example implementation, the actuator mechanism 210 is a hydraulic actuator mechanism including a cylinder 225 configured to actuate along the substantially horizontal structure 105 away from the end 115 of the horizontal structure 105.

The cylinder 225 is configured to be connected to the tension member 215. The mechanism or structure by which the tension member 215 is connected to the cylinder 225 is not limited to a particular structure, and may be a semi-permanent connection mechanism that is not removable without significant tooling, such as a welded connection, For example, and not by way of limitation, a releasable connection may be provided, such as a screw connection, a bolt connection or an electromagnetic connection. However, example implementations of the actuator mechanism 210 are not limited to this configuration or structure, and may have other configurations or structures as may be apparent to a person of ordinary skill in the art.

The ballast weight 205 may be sized, shaped, and weighted to provide the ballast required by the heavy equipment 100. Further, in this example implementation, the ballast weight 205 may also include a fastener mechanism 230 configured to engage the locking mechanism 300, as discussed in greater detail below. For example, and not by way of limitation, the fastener mechanism 230 may be formed as a hook member configured to engage a portion of the locking mechanism 300, and may be suspended thereby.

The ballast weight 205 may include one or more connection points 235 that may connect to the tension member 215. The mechanism of connecting the tension member 215 to the connection points 235 is not limited to a particular structure, and may be a semi-permanent connection mechanism that is not removable without significant tooling, such as a welded connection, for example, and not by way of limitation, or a releasable connection, such as a screw connection, a bolt connection or an electromagnetic connection, for example. However, example implementations of the ballast weight are not limited to this configuration or structure, and may have other configurations or structures as may be apparent to a person of ordinary skill in the art.

As shown in FIGS. 1-4, the tension member 215 is a linear member configured to transmit linear movement of the actuator mechanism 210 horizontally into linear movement of the ballast weight 205. The tension member 215 may be formed from a material having sufficient strength and, with sufficient dimension, to withstand the tension required to transmit the force generated by the linear movement of the actuator mechanism 210 into lifting force sufficient to lift the ballast weight 205. For example, and not by way of limitation, the tension member 215 may be a steel cable or similar structure capable of withstanding the tension required to lift the ballast weight off of the base 110 or the surface beneath the horizontal section 105.

Example implementations of the tension member 215 are not limited to steel cables and may be, for example, and not by way of limitation, a wire, string, cable, fiber member or other structure capable of withstanding the tension required to lift the ballast weight 205 vertically.

Additionally, in some example implementations, the tension member 215 may be strung across, and contact, the surface of a roller member 220, such as a sheave. The roller member 220 may rotate due to friction contact with the tension member 215 as the ballast weight 205 is raised or lowered. However, example implementations need not include a roller member 220, and may have an alternative structure as may be apparent to a person of ordinary skill in the art. For example, a greased surface may be provided for the tension member to pass over.

In some example implementations, lock mechanism 300 may include a retaining member 305 and a lock actuator 310. The retaining member 305 may be configured to be movable between a retaining position and a releasing position. In the retaining position, the retaining member 305 may be configured to engage the fastening member 230 of the ballast weight 205 when the ballast weight 205 is raised into the upper position illustrated in FIGS. 3 and 4.

In the releasing position, the retaining member 305 may be configured to not engage the fastening member 230 and allow the ballast weight to be lowered to position shown in FIGS. 1 and 2. The retaining member 305 may be, for example, and not by way of limitation, a hanger pin or other structure capable of engaging the fastening member 230 to support the ballast weight 205 as may be apparent to a person of ordinary skill in the art.

In some example implementations, the lock actuator 310 may be configured to move the retaining member 305 from the retaining position to the releasing position. For example, and not by way of limitation, the lock actuator 310 may be a linear or rotational actuator configured to move the retaining member from the retaining position to the releasing position. Further, in some example implementations, the lock actuator 310 may move the retaining member from the releasing position to the retaining position.

In some further example implementations, a biasing member 315 is configured to provide a biasing force to the retaining member 305 toward the retaining position. For example, and not by way of limitation, the biasing member may be a spring configured to provide a spring force to the retaining member 305 to push or pull the retaining member 305 into the retaining position if no obstruction or other force is present. In some example implementations, the lock actuator 310 may be configured to generate sufficient actuating force to overcome the biasing force provided by the biasing member 315, and thus move the retaining member 305 into the releasing position.

Figure 5:
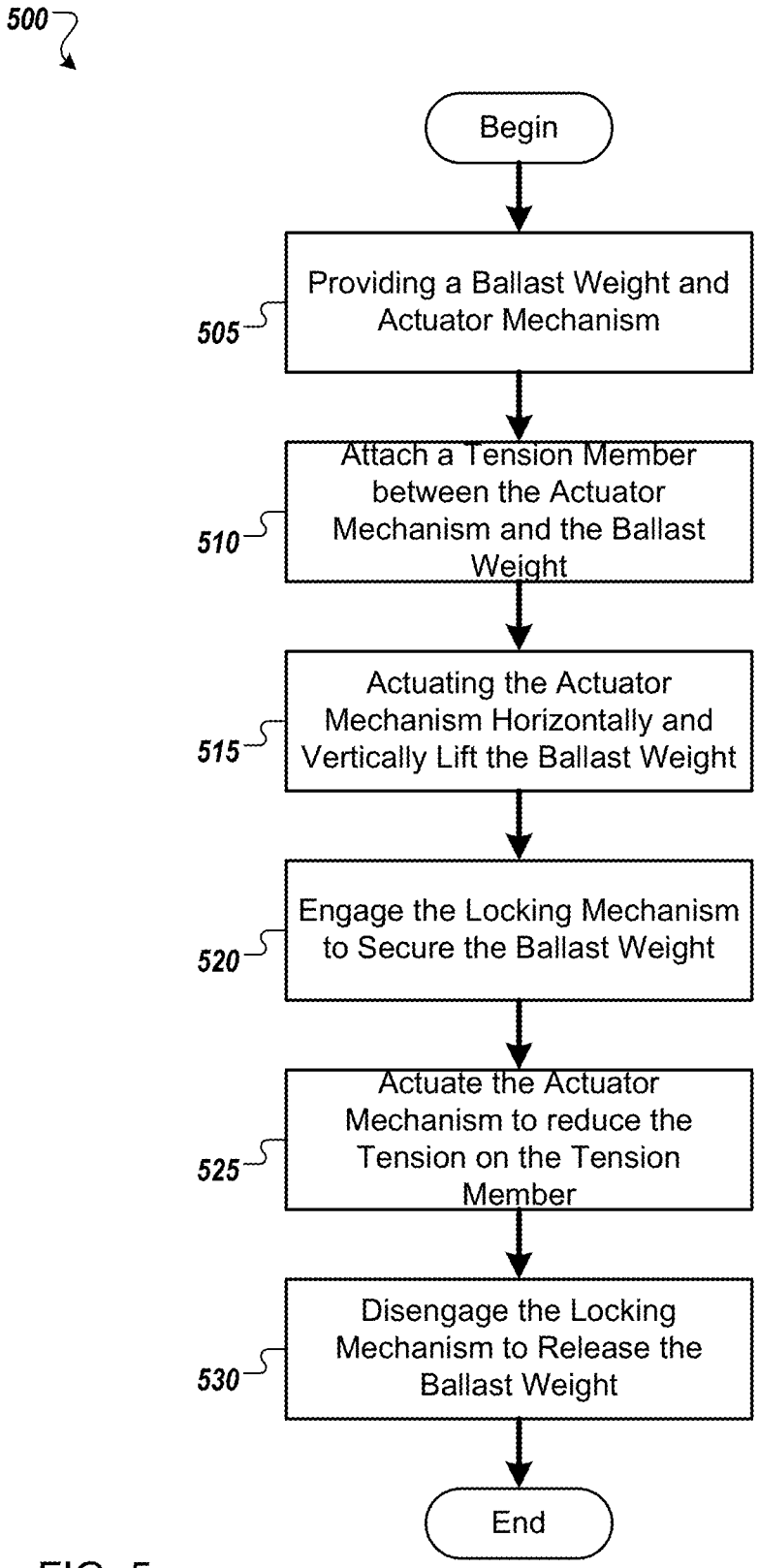
FIG. 5 provides a flow chart showing a process for removably installing ballast on a piece of heavy equipment according to an example implementation.

FIG. 5 provides a flow chart showing a process 500 for removably installing ballast on a piece of heavy equipment according to an example implementation. Example implementations of this process may be used with structures such as the structures shown in FIGS. 1-4. The following discussion of the process makes reference to the structures of FIGS. 1-4 for clarity. However, example implementations of the process 500 need not use structures identical to the structures illustrated in FIGS. 1-4 and may use alternative structures that can perform the function of the above-described structures, and may perform other functions as well, as may be apparent to a person of ordinary skill in the art.

In the process 500, a ballast weight 205 and an actuator mechanism 210 are provided in 505. As illustrated in FIGS. 1-4, the actuator mechanism 210 may be provided on the horizontal structure 105 of the heavy equipment 100 and the ballast weight 205 may be positioned or resting on a base 110 or the ground below the end 115 of the horizontal structure.

In 510, a tension member 215 is attached to the actuator mechanism 210 and to the ballast weight 205. For example, and not by way of limitation, one end of the tension member 215 may be attached to the cylinder 225 of the actuator mechanism 210, and another end of the tension member 215 may be attached to a connection point 235 of the ballast weight 205. The mechanism of connecting the tension member 215 to the cylinder 225 or to the connection point 235 is not particularly limited, and may be a semi-permanent connection mechanism that is not removable without significant tooling, such as a welded connection, for example, or a releasable connection, such as a screw connection, a bolt connection or an electromagnetic connection, for example.

Once the tension member 215 is attached to the actuator mechanism 210 and the ballast weight, the actuator mechanism 210 may be actuated along the horizontal structure 105 away from the end portion 115 in 515. As the actuator mechanism 210 is moved along the horizontal structure 105, the end of the tension member 215 connected to the actuator mechanism 210 is forced horizontally along the horizontal structure 105 and the tension member 215 moves along the surface of the roller member 220. Further, as the tension member 215 moves along the surface of the roller member 220, the roller member 220 may rotate, and the end of the tension member 215 connected to the ballast weight 205 is pulled vertically upward.

The actuator mechanism 210 continues to move along the horizontal structure 105, pulling the ballast weight 203 upward until the ballast weight 205, or a portion thereof (such as the fastener member 230) engages the locking mechanism 300 in 520. For example, the fastener member 230 may engage the retaining member 305 of the locking mechanism 300.

In some example implementations, the fastening member 230 may temporarily compress or extend the biasing member 315 such that the retaining member 305 is out of the retaining position as the fastening member 230 moves upward. Once the fastening member 230 moves a sufficient distance past the retaining member 305, the biasing member 315 causes the retaining member 305 to return to the retaining position engaging the fastening member 230.

Once the ballast weight 205 engages the locking mechanism 300, the actuator mechanism 210 may be actuated back along the horizontal structure 105 toward the end portion 115 in 525. By actuating the actuator mechanism 210 back toward the end portion 115, the tension in the tension member 215 may be reduced to zero, and the ballast weight 205 may be held in position by the locking mechanism 300.

Optionally, in some example implementations, in 530 the ballast weight 205 may be disengaged or uninstalled from the horizontal structure 105 of the heavy equipment 100 for transportation, replacement, or maintenance.

Figure 6:
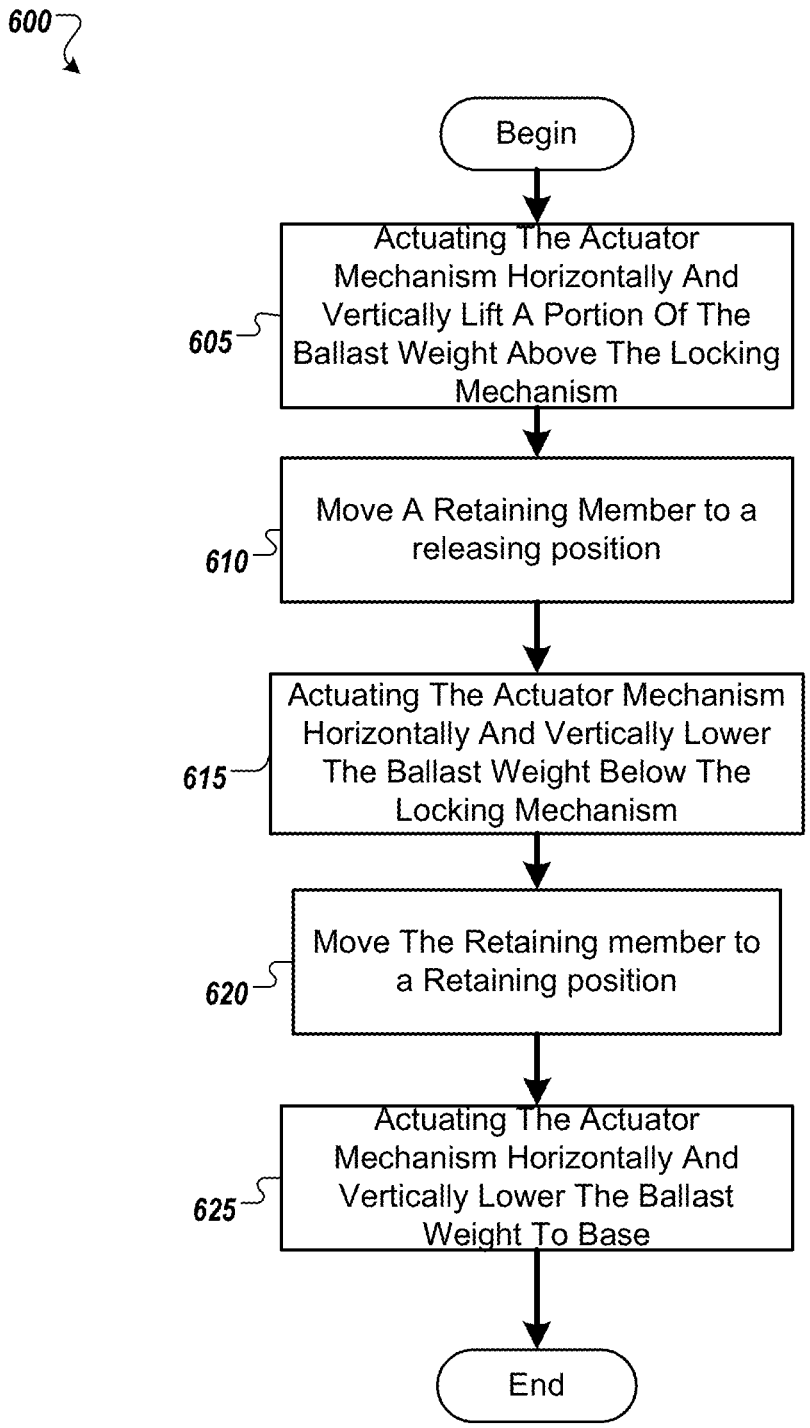
FIG. 6 provides a flow chart showing a process for disengaging or uninstalling ballast weight from a piece of heavy equipment according to an example implementation.

FIG. 6 provides a flow chart showing an example implementation of a process 600 for disengaging or uninstalling a ballast weight 205 from a piece of heavy equipment 100 in 530.

In the process 600, the actuator mechanism 210 may be actuated along the horizontal structure 105 away from the end portion 115, as discussed above with respect to 515 of process 500. As the actuator mechanism 210 is moved along the horizontal structure 105, the end of the tension member 215 connected to the actuator mechanism 210 is pulled horizontally along the horizontal structure 105 and the end of the tension member 215 connected to the ballast weight 205 is pulled substantially vertically upward in 605.

In 605, the actuator mechanism 210 may be moved only a distance necessary to lift the portion of the ballast member 205 (for example, the fastening member) engaging the locking mechanism 300 lifted above a portion of the locking mechanism (for example, the retaining member 305).

Once the portion of the ballast member 205 is lifted above the portion of the locking mechanism 300, the lock actuator 310 may be activated to move the retaining member 305 into the releasing position in 610. Once the retaining member 305 is moved into the releasing position 610, the actuator mechanism 210 may be actuated along the horizontal structure 105 toward the end portion 115 in 615. By actuating the actuator mechanism 210 toward the end portion 115, the ballast weight 205 may be lowered to a position below the locking mechanism 300.

In some example implementations, once the ballast weight 205 is lowered below the locking mechanism 300, the retaining member may be moved back to the retaining position in 620, either by the lock actuator directly moving the retaining member or by a biasing force provided by the biasing member 315.

Further, in 625, the actuator mechanism 210 may continue to be actuated back along the horizontal structure 105 toward the end portion 115 further lowering the ballast weigh 205 until the biasing member is resting on the base 110 or the ground.

The foregoing detailed description has set forth various example implementations of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware.

While certain example implementations have been described, these example implementations have been presented by way of example only, and are not intended to limit the scope of the protection. Indeed, the novel apparatuses described herein may be embodied in a variety of other forms. Furthermore, various omissions, substitutions and changes in the form of the systems described herein may be made without departing from the spirit of the protection. The accompanying claims and their equivalents are intended to cover such forms or modifications as would fall within the scope and spirit of the protection.

What is claimed is:

1. A ballast system for heavy equipment including a horizontal structure, the ballast system comprising:

a ballast weight configured to be removably mounted, proximate to an end of a portion of the horizontal structure of the heavy equipment;

at least one actuator mounted on the horizontal structure of the heavy equipment, the at least one actuator operable between a first position and a second position, and oriented to actuate horizontally along at least a portion of the horizontal structure;

at least one tension member that connects the ballast weight to the actuator and is configured to move the ballast weight vertically in response to the at least one actuator actuating along at least a portion of the horizontal structure; and a locking mechanism configured to removably attach the ballast weight to the end portion of the horizontal structure, the locking mechanism comprising:

a retractable retaining member disposed on the horizontal structure, the retractable retaining member comprises a lock actuator configured to move the retractable retaining member relative to the horizontal structure and;

a biasing member, independent of the lock actuator, the biasing member being disposed on the horizontal structure, the biasing member continually applying a biasing force to the retaining member that urges the retaining member toward the ballast weight, wherein the retractable retaining member is continuous urged by the biasing member into a retaining position to engage the ballast weight as the ballast weight is moved vertically by the at least one tension member and automatically locks the ballast weight to the end portion when the ballast weight is positioned adjacent the horizontal structure;

wherein the lock actuator moves the retractable retaining member against the biasing force of the biasing member, from a retaining position to a releasing position when the lock actuator is activated.

2. The on-board ballast system of claim 1, the ballast weight comprising a fastening member, and wherein in the retaining position the retractable retaining member is positioned to contact the fastening member so as to hold the ballast weight to the end portion of the horizontal structure, and in the releasing position the retractable retaining member is positioned to not contact the fastening member to releases the fastening member so as to allow the ballast weight to be moved vertically.

3. The on-board ballast system of claim 2, the fastening member comprising a hook member, wherein the retractable retaining member comprises:

a hanger pin moveable between the retaining position and the releasing position, and configured to engage the hook member in the retaining position.

4. The on-board ballast system of claim 3, wherein the biasing member is configured to provide a biasing force to bias the hanger pin member toward the retaining position, and wherein the lock actuator is configured to provide an actuating force sufficient to overcome the biasing force of the biasing member and move the hanger pin between the retaining position and the releasing position.

5. The on-board ballast system of claim 1, wherein the at least one actuator is a hydraulic actuator.

6. The on-board ballast system of claim 1, further comprising a roller member disposed proximate to the end portion of the horizontal structure and configured to contact the tension member and redirect horizontal of an upper portion of the tension member into vertical movement of a lower portion of the tension member.

7. A piece of heavy equipment comprising:

a horizontal structure;

a base structure vertically separated from the horizontal structure; and a ballast system comprising:

a ballast weight configured to be removably mounted, proximate to an end of a portion of the horizontal structure of the heavy equipment;

at least one actuator mounted on the horizontal structure of the heavy equipment, the at least one actuator operable between a first position and a second position, and oriented to actuate horizontally along at least a portion of the horizontal structure;

at least one tension member that connects the ballast weight to the actuator and is configured to move the ballast weight vertically in response to the at least one actuator actuating along at least a portion of the horizontal structure; and a locking mechanism configured to removably attach the ballast weight to the end portion of the horizontal structure, the locking mechanism comprising:

a retractable retaining member disposed on the horizontal structure, the retractable retaining member comprises a lock actuator configured to move the retractable retaining member relative to the horizontal structure and;

a biasing member, independent of the lock actuator, the biasing member being disposed on the horizontal structure, the biasing member continually applying a biasing force to the retractable retaining member that urges the retaining member toward the ballast weight, wherein the retractable retaining member is continuous urged by the biasing member into a retaining position to engage the ballast weight as the ballast weight is moved vertically by the at least one tension member and automatically locks the ballast weight to the end portion when the ballast weight is positioned adjacent the horizontal structure; wherein the lock actuator moves the retractable retaining member against the biasing force of the biasing member, from a retaining position to a releasing position when the lock actuator is activated.

8. The piece of heavy equipment of claim 7, the ballast weight comprising a fastening member, and wherein in the retaining position the retractable retaining member is positioned to contact the fastening member so as to hold the ballast weight to the end portion of the horizontal structure, and in the releasing position the retractable retaining member is positioned to not contact the fastening member to releases the fastening member so as to allow the ballast weight to be moved vertically.

9. The piece of heavy equipment of claim 8, the fastening member comprising a hook member, wherein the retractable retaining member comprises:

a hanger pin moveable between the retaining position and the releasing position, and configured to engage the hook member in the retaining position.

10. The piece of heavy equipment of claim 9, wherein the biasing member is configured to provide a biasing force to bias the hanger pin member toward the retaining position, and wherein the lock actuator is configured to provide an actuating force sufficient to overcome the biasing force of the biasing member and move the hanger pin between the retaining position and the releasing position.

11. The piece of heavy equipment of claim 7, wherein the at least one actuator is a hydraulic actuator.

12. The piece of heavy equipment of claim 7, further comprising a roller member disposed proximate to the end portion of the horizontal structure and configured to contact the tension member and redirect horizontal of an upper portion of the tension member into vertical movement of a lower portion of the tension member.

13. A method of removably installing ballast on heavy equipment comprising a horizontal structure, the method comprising:

providing a ballast weight configured to be removably attached to an end of a portion of the horizontal structure;

providing an actuator on the horizontal structure;

attaching a tension member between the actuator and the ballast weight;

actuating the actuator to move horizontally along a portion of the horizontal structure so as to vertically lift the ballast weight vertically toward the end of the portion of the horizontal structure; and engaging a locking mechanism to attach the ballast weight to the end portion of the horizontal structure, wherein the engaging the locking mechanism comprises continuously applying a biasing force, by a biasing member, to urge a retractable retaining member toward the ballast weight to automatically engage a fastening member on the ballast weight as the ballast weight is lifted vertically and automatically lock the ballast weight to the end portion of the horizontal structure when the ballast weight is positioned adjacent the horizontal structure.

14. The method of claim 13, comprising disengaging the locking mechanism by:

actuating the actuator to move horizontally along the portion of the horizontal structure and vertically lift the fastening member of the ballast weight above the locking mechanism;

moving, by a lock actuator, the retractable retaining member of the locking mechanism against the biasing force of the biasing member into a releasing position that does not engage the fastening member of the ballast weight; and actuating the actuator to vertically lower the fastening member of the ballast weight below the locking mechanism.

15. The method of claim 13, wherein the retractable retaining member comprises a hanger pin biased into a retaining position to engage a fastening member provided on the ballast weight, wherein the fastening member comprises a hook member.

16. The method of claim 15, comprising disengaging the locking mechanism by:

actuating the actuator to move horizontally along the portion of the horizontal structure and vertically lift the hook member of the ballast weight above the hanger pin;

moving, by the lock actuator, the hanger pin into a releasing position that does not engage the hook member of the ballast weight; and actuating the actuator to vertically lower hook member of the ballast weight below the hanger pin.

17. The method of claim 13, further comprising stringing the tension member over a roller member to redirect horizontal movement of an upper portion of the tension member into vertical movement of a lower portion of the tension member.

* * * * *